US007178712B2

(12) United States Patent
Schultz et al.

(10) Patent No.: US 7,178,712 B2
(45) Date of Patent: Feb. 20, 2007

(54) RECLOSEABLE, CUBOIDAL FOLDING BOX HAVING A TAMPERPROOF SEAL AND A HANGING TAB

(75) Inventors: Günther Schultz, Hamburg (DE); Andreas Schabert, Seeveral (DE)

(73) Assignee: Beiersdorf AG, Hamburg (DE)

( * ) Notice: Subject to any disclaimer, the term of this patent is extended or adjusted under 35 U.S.C. 154(b) by 317 days.

(21) Appl. No.: 10/651,904

(22) Filed: Aug. 29, 2003

(65) Prior Publication Data

US 2004/0195298 A1 Oct. 7, 2004

(30) Foreign Application Priority Data

Aug. 29, 2002 (DE) ..... 102 39 711

(51) Int. Cl.
*B65D 5/462* (2006.01)
*B65D 17/28* (2006.01)

(52) U.S. Cl. ..... 229/102; 206/806; 206/807; 229/117.14; 229/153

(58) Field of Classification Search ..... 229/102, 229/151, 152, 153, 117.13, 117.14, 223; 206/806, 206/807

See application file for complete search history.

(56) References Cited

U.S. PATENT DOCUMENTS

| | | | | |
|---|---|---|---|---|
| 1,829,533 | A * | 10/1931 | Ondricek | 229/117.13 |
| 2,249,244 | A * | 7/1941 | Guyer | 226/152 |
| 2,260,137 | A * | 7/1941 | Donnelly | 229/152 |
| 3,181,772 | A * | 5/1965 | Collins et al. | 229/117.13 |
| 3,662,945 | A * | 5/1972 | Foster et al. | 229/132 |
| 4,266,671 | A * | 5/1981 | Roccaforte | 229/152 |
| 4,291,807 | A * | 9/1981 | Giordano et al. | 229/152 |
| 5,190,155 | A | 3/1993 | Grunwald | |
| 2002/0070268 | A1 * | 6/2002 | Schultz | 229/117.14 |

FOREIGN PATENT DOCUMENTS

| | | |
|---|---|---|
| DE | 3932441 | 4/1991 |
| DE | 4322555 | 1/1995 |
| DE | 19535008 | 3/1997 |
| DE | 29521697 | 3/1998 |
| DE | 19821087 | 11/1999 |
| DE | 19848719 | 8/2001 |
| DE | 10061402 | 6/2002 |
| EP | 1020367 | 7/2000 |
| JP | 08198243 | 8/1996 |
| JP | 10086934 | 4/1998 |
| WO | WO 01/85549 | 11/2001 |

* cited by examiner

*Primary Examiner*—Gary E. Elkins
(74) *Attorney, Agent, or Firm*—Alston & Bird LLP

(57) ABSTRACT

The invention relates to a reclosable, cuboidal folding box having a rear wall, a front wall, two or more side walls which connect the front and rear walls, a base closure, and a top closure, which is formed by three closure tabs and has an insertion flap. A double-layered hanging tab is articulated on the front wall or the rear wall via a severable tamperproof surface, which is fixed to the insertion flap.

12 Claims, 5 Drawing Sheets

RECLOSEABLE, CUBOIDAL FOLDING BOX HAVING A TAMPERPROOF SEAL AND A HANGING TAB

BACKGROUND OF THE INVENTION

German Patent Application DE 39 32 441 discloses a reclosable folding box that includes a front wall and a rear wall as well as two side walls which connect the front wall and the rear wall, a base part and a top closure tab. The closure tab is connected, via a fastening flap, to an insertion tongue. This folding box does not provide any possible means for hanging it on a hook.

German Patent Application DE 4322555 likewise discloses a reclosable, cuboidal folding box. This folding box comprises a rear wall, which is formed by an outer side-wall part and an inner side-wall part, a front wall, two side walls which connect the front wall and the rear wall, a base closure and a top closure. The outer side-wall part has, in its top region, a hanging tab with a correspondingly shaped hanging device, for example round holes or slots. The hanging tab can be used to position the folding box on a hook.

However, since the hanging tab is merely of single-layer design and consists of the same material as the rest of the folding box, problems arise during practical usage of the folding box.

If, taking into consideration environmental reasons and reasons of cost, the folding box is produced from thin material, the hanging tab has insufficient stability. Even if the folding box is subjected to a slight, unintentional pulling action, the hanging tab tears off, with the result that the hanging tab loses its function and it is no longer possible for the box to be hung up as desired. Furthermore, the appearance of the box is adversely affected and it is no longer possible for the box to be displayed to the customer.

Conversely, producing the folding box from thicker, more stable, material means that, although the hanging tab can be subjected to tensile loading to a much greater extent, a large amount of material is wasted unnecessarily at the same time because the rest of the walls of the folding box are overdimensioned.

DE 19541904 discloses a similar folding box. The folding box comprises a front wall, a rear wall, a right-hand side wall, which connects the front wall and the rear wall, and a left-hand side wall. The box has a base closure, which is formed by four base-closure tabs, and a top closure, which is formed by four closure tabs, two closure tabs of the top closure and two base-closure tabs being adhesively bonded to one another. Furthermore, integrated in the front wall or in the rear wall is a tear-open flap which is retained in the front wall or the rear wall by means of a weakening or predetermined tearing line and is connected to a closure tab of the top closure or to a base closure tab of the base closure via a folding line. At least one inner rear wall is provided in the folding box, to be precise if the tear-open flap is located in the rear wall. In the case where the tear-open flap is located in the front wall, then an intermediate wall and, adjoining the intermediate wall, an inner front wall are articulated.

Articulated on the rear wall, in the region of the latter which is free of the tear-open flap, is a first hanging tab, which is located in the plane formed by the rear wall and has a hanging device, such as slots or round holes. At the same time, a second hanging tab with a hanging device, such as slots or round holes, is punched out of the same region of the inner rear wall as in the case of the rear wall, starting from the folding line between the inner rear wall and closure tab, it being the case that the closure tab which is articulated on the inner rear wall has a greater width at the folding line than the second hanging tab.

German patent DE 19535008 discloses a reclosable, cuboidal folding box having a front wall, a rear wall, a left-hand side wall, which connects the front wall and the rear wall, and a right-hand side wall, having a reclosable base, preferably comprising three base-closure tabs articulated on the side walls, and having three further closure tabs, which are articulated on the front wall, on the left-hand side wall, which connects the front wall and the rear wall, and on the right-hand side wall and which are located opposite the base closure tabs, and having a fourth closure tab, which is articulated on the rear wall and, together with the three further closure tabs, forms the top closure of the folding box, this making it possible to have a secure and stable means of hanging the folding box on the known self-service hooks of sales racks within shops or pharmacies.

This folding box has a double-layer hanging means, but does not have a tamperproof seal which is reclosable.

German patent DE 19821087 discloses a reclosable, cuboidal folding box having a front wall, a rear wall, a right-hand side wall, which connects the front wall and the rear wall, and a left-hand side wall, having a base closure, which is formed by four base-closure tabs, having a top closure, which is formed by four closure tabs, it being possible for two closure tabs at the top closure and two base-closure tabs to be adhesively bonded to one another. This folding box has a tear-open flap, which is integrated in the front wall or the rear wall of the box, is retained in the front wall or the rear wall by means of a weakening or predetermined tearing line and is connected to a closure tab of the top closure or to a base-closure tab of the base closure via a folding line. The box also has at least one inner rear wall, on which, if appropriate, an intermediate wall and, adjoining the intermediate wall, an inner front wall are articulated.

Furthermore, a swing flap is integrated in the front wall or the rear wall by means of two weakening or predetermined tearing lines and is adhesively bonded in a reversible manner by at least one spot of adhesive.

One disadvantage associated with all of the boxes known from the prior art is that, insofar as they have the tamperproof seal disclosed by DE 4322555, the hanging means is always provided on that side of the folding box which is located opposite the tamperproof seal, i.e., in the base region of the folding box when the above-mentioned folding boxes are ones with a single-part blank. For the reasons specified above, the task of subsequently adhesively bonding a hanging means on the box is always to be avoided.

Another disadvantage of all of the known folding boxes from the prior art is that these boxes all comprise a relatively large amount of material in order to ensure the provision of a hanging means and, at the same time, a reclosure capability.

SUMMARY OF THE INVENTION

Folding boxes are used as packaging and, at the same time, as advertisement carriers for the products which are to be sold therein. The packaging costs, including the costs of materials in addition to the straightforward automatic filling and adhesive-bonding operations, should preferably be kept as low as possible.

It is thus an object of various embodiments of the present invention to provide a folding box that has both a stable hanging tab and a reclosable closure and can be produced with low material outlay. It is further an object of various embodiments of the present invention to provide a folding box which can be erected, filled and closed easily and quickly with the aid of machines. In various embodiments of the invention, the folding blank, which includes an integrated hanger and closure flap, is in a single piece.

A reclosable, cuboidal folding box according to one embodiment of the invention comprises: (1) a front wall; (2) a rear wall; (3) two or more (e.g., three) side walls which connect the front and rear walls; (4) a base closure, which, in one embodiment, is formed by four base-closure tabs; and (5) a top closure, which is formed by three closure tabs and has an insertion flap, a double-layered hanging tab that is articulated on the front wall or the rear wall via a severable tamperproof surface. The tamperproof surface is preferably attached to the insertion flap. The invention also comprises a punched blank of the folding box according to the invention.

A folding box according to a particular embodiment of the invention comprises a tamperproof surface. Furthermore, a folding box according to one embodiment of the invention has an articulated, double-layer hanging tab, which is preferably adhesively bonded to the centre of a lid-like top side of the box. When the box is opened for the first time, a centrally-embedded tamperproof surface, which is preferably located in the top region of the boxes' front or rear wall, which can be severed by way of perforations, is configured so that it separates from the body of the folding box when a user applies pressure to the tamperproof surface. During this pressing-in action, the perforation-weakened connections between the box's lid surface and the box's body are also separated from the front or rear wall.

This severed tamperproof surface (also referred to as "the tamperproof seal"), remains with the lid surface and the centrally adhesively bonded hanging tab on the lid closure which is to be opened. In one embodiment of the invention, this lid closure has an insertion flap on its broad side surface. This insertion flap facilitates enclosure of the folding box and is configured to be introduced into the body of the folding box when the latter is closed for the first time. The tab-like free surface produced by virtue of the tamperproof surface being initially torn away from the box's body serves as an opening aid when the folding box is subsequently reopened.

In a particular embodiment of the invention, the two hanging tabs are adhesively bonded to one another during an adhesive-bonding process in a box folding machine. This results in an extremely straightforward closing technique in the filling process during production.

The interconnected parts of the folding box are preferably adhesively bonded in a manner known in the art using conventional adhesive-bonding material. However, as will be understood by one skilled in the art, it is also possible to use other known connection means to assemble the box.

BRIEF DESCRIPTION OF THE DRAWINGS

Various exemplary embodiments of the folding box according to the invention are describe in more detail below with reference to FIGS. 1–5, which are not necessarily drawn to scale.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
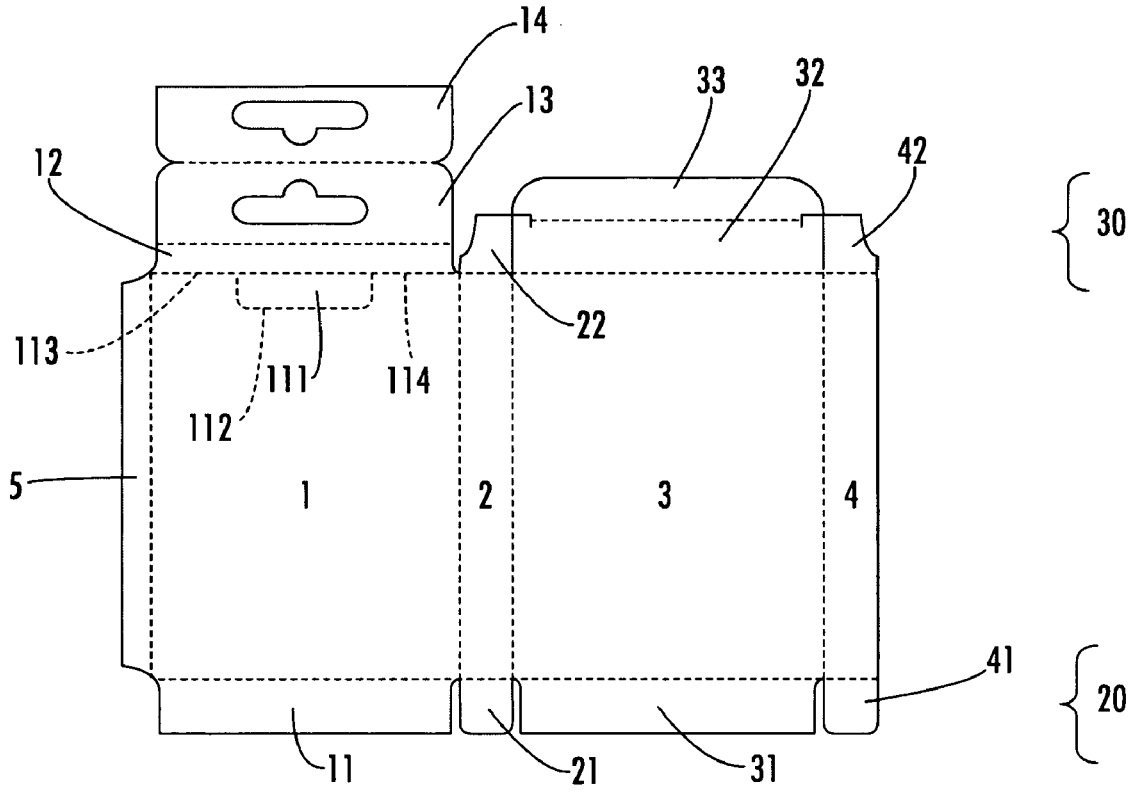
FIG. 1 depicts a folding-box blank according to one embodiment of the invention.

FIG. 1 shows the folding-box blank before it is adhesively bonded to form the finished folding box. As may be understood from this figure, one embodiment of the invention comprises a reclosable, cuboidal folding box having a front wall (1) and a rear wall (3). These front and rear walls (1, 3), along with three articulated side walls (2, 4, 5), form the basic body of the folding box. The side walls (2, 4, 5) are preferably narrower than the front wall (1) and rear wall (3). When the box is assembled, two of the side walls (4, 5) are connected, and preferably adhesively bonded, to one another in a position in which they are located one above the other. The inner side wall (5) preferably has a smaller width than the side wall (4) connected to it. As a result, sufficient strength and stability are achieved via the surfaces (4, 5) which are preferably adhesively bonded and, at the same time, the amount of material required for the folding box is minimized.

The base closure (20) comprises two base-closure flaps (11, 31) and two dust flaps (21, 41). When the box is assembled two or more of these flaps are preferably adhesively bonded to one another, which adds to the box's strength and stability.

The top closure (30) comprises a closure flap (32) that is articulated on either the front or rear wall (1, 3), and two dust flaps (22, 42), which are all articulated, respectfully, on the side walls (2, 4). An insertion flap (33) is articulated on the closure flap (32) for reclosure purposes. In one embodiment of the invention, the front wall (1) comprises a tamperproof surface (111) which can be severed by way of perforations (112). This tamperproof surface (111) is preferably provided in the centre of the top edge of the front wall (1).

Articulated on the tamperproof surface (111) is a lid flap (12), which is preferably adhesively bonded to the closure flap (32) when the box is in a closed state. This lid flap (12) is preferably designed to correspond in length to the front and rear walls (1, 3), but preferably is only half (or only about half) of the width of the closure flap (32). Articulated on the lid flap (12) are two connected hanging tabs (13, 14), which together form a double-layered hanger (13, 14).

Figure 3A:
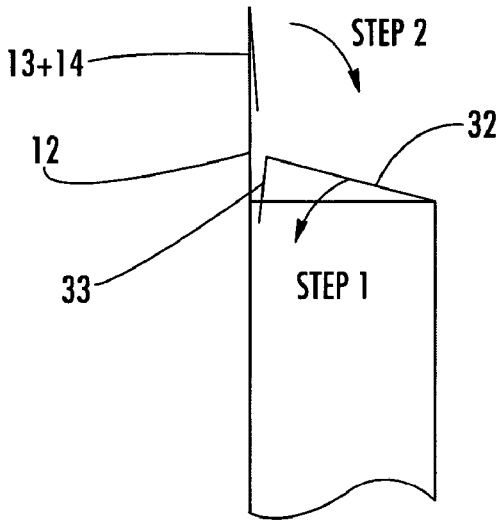
FIGS. 3*a* and 3*b* show the top of a box according to one embodiment of the invention, during the closing operation.
Figure 3B:
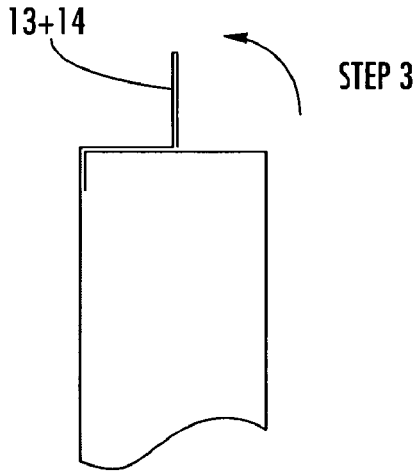

Because, in one embodiment of the invention, the lid flap (12) is only half the width of the closure flap (32) to which it is adhesively bonded, the hanger (13, 14), once erected and adhesively bonded together, in a particular embodiment of the invention, the hanger is located in the centre of the top folding-box closure (30) (See FIG. 3*b*). In the case of very narrow folding boxes, in order to ensure sufficient gluing in the cartoning machine, the width of the surface (12) is preferably somewhat greater than half the width of the closure flap (32).

Adhesively bonding the tamperproof surface (111) to the insertion flap (33) surprisingly contributes to creating a straightforward means of providing a stable, closed folding box which uses up extremely small amounts of materials.

The lid flap (12) is preferably fastened to the front wall (1) via a perforated joint (113, 114), which results in greater stability for the folding box. The lid flap (12) may be torn away from the front wall (1) along the perforated joint (113, 114) using a pressing-in or tearing action.

In one embodiment of the invention, the integration of the hanger (13, 14) into the blank of the folding box allows the folding box to be completed within one operating step. This avoids the need to adhesively bond a hanger to the box.

Figure 2:
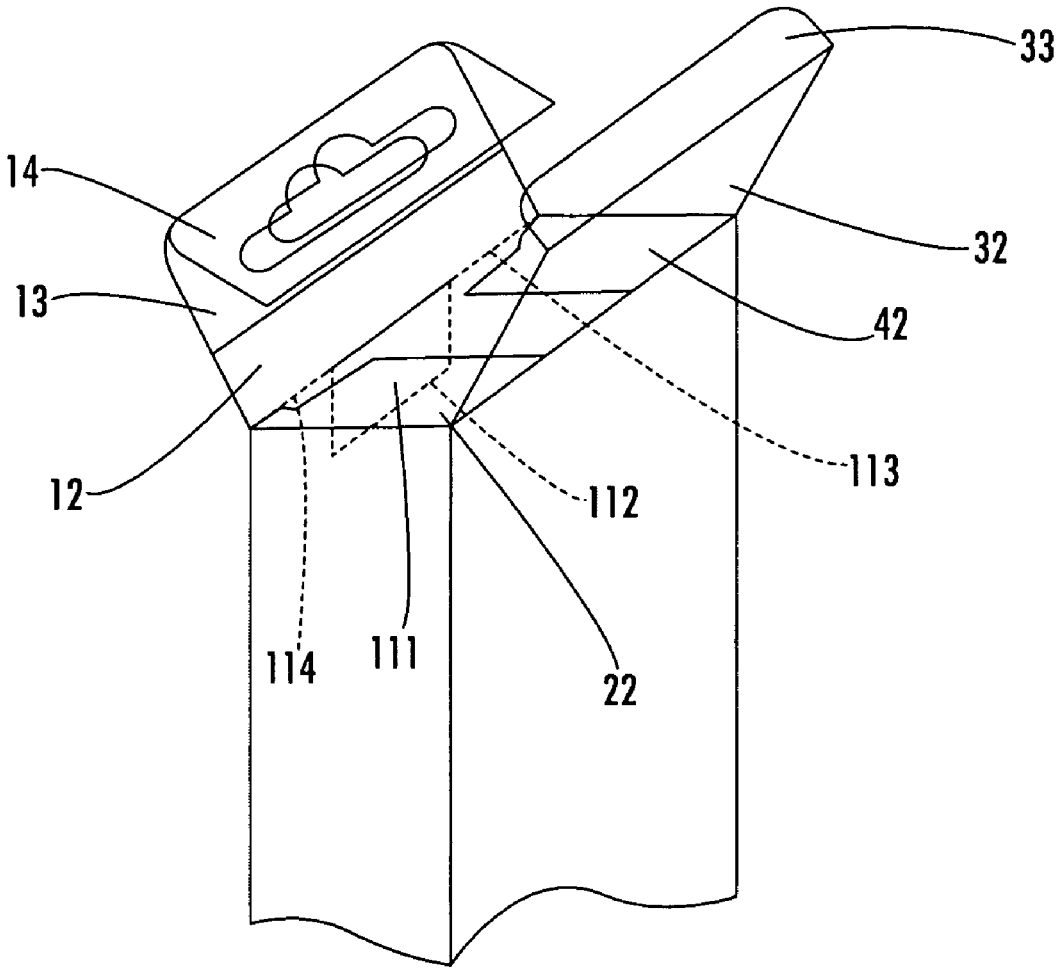
FIG. 2 is a perspective view of the top of a box according to a particular embodiment of the invention.

FIG. 2 shows the folding box with the insertion flap (33) in an open position. The two tabs (13, 14) that form the hanger, are to be adhesively bonded to one another to form a stable double-layer hanger (See FIGS. 3*a* and 3*b*). For aesthetic and functional purposes, it is also possible for the free corners of the two hanging tabs (13, 14) to be rounded identically, preferably in the form of quarter-circles.

As shown in FIG. 3*a*, in a first step of the operation for closing the folding box, the closure flap (32) is positioned adjacent the dust flaps (22, 42) and the insertion flap (33) is guided into the folding box. In the second step, the lid flap (12) is adhesively bonded to the closure flap (32) and, in the third step, the adhesively bonded hanger (13, 14) is erected (FIG. 3*b*) so that it is substantially perpendicular to the top of the box.

Figure 4:
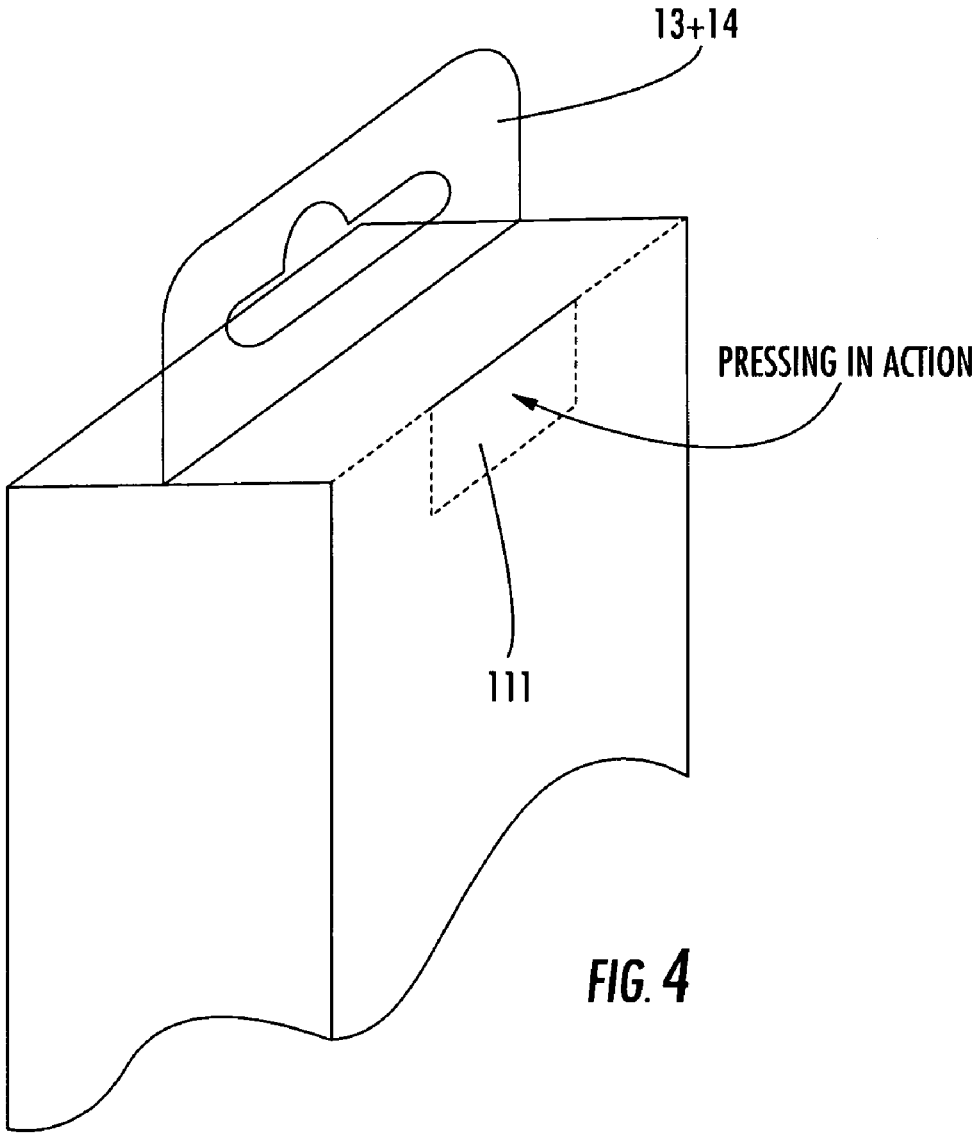
FIG. 4 shows the top of a box, according to one embodiment of the invention, in a closed state.
Figure 5:
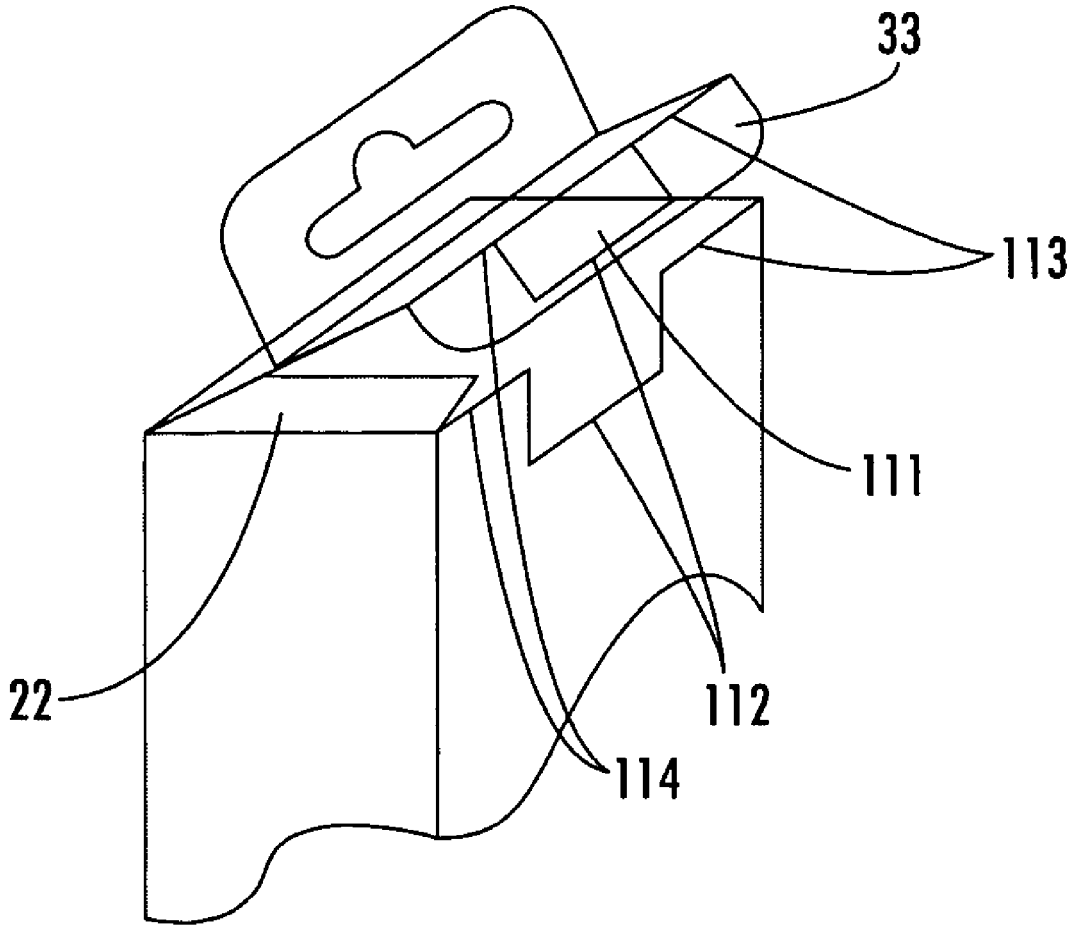
FIG. 5 shows the top of a box, according to one embodiment of the invention, in which the folding box is open and the box's tamperproof surface has been torn out of the box's body.

FIG. 4 shows the closed folding box with the erected hanger and the tamperproof surface (111). As shown in FIG. 5, to open the box, a user applies pressure to the tamperproof surface (111) which serves to tear the tamperproof surface (111) away from the body of the folding box. This embodiment of the invention thus complies with safeguarding measures which allow unintended opening to be detected immediately.

FIG. 5 shows the open folding box with the tamperproof surface (111) adhesively bonded to the insertion flap (33). Reclosure of the box is facilitated by virtue of the insertion flap (33) being reintroduced into the gap formed from the dust flaps (22, 42) and the front wall (1).

With the exception of the hanger and the envisaged adhesive-bonding areas, the folding box according to one embodiment of the invention is of single-layer design. This serves to minimize the amount of material used to manufacture the box. Furthermore, a folding box according to the invention is machine-compatible (i.e., can be formed in a fully automated manner from a punched blank).

Once the folding box has been erected and filled, simple adhesive bonding of the folding box is possible. This adhesive bonding achieves good dust proofing, thus dispensing with the need for the folding box to be subsequently fully wrapped or provided with additional packaging. In one embodiment, the folding box is adhesively bonded, dust-proof, provided with a tamperproof seal, and reclosable. It is also preferably easy to handle. Furthermore, the folding box is preferably environmentally friendly and, in one embodiment of the, is produced from a single folding blank with minimum material consumption.

The hanging means is preferably articulated to ensure central hanging when the pack is closed and adhesively bonded. This makes it easier to hang the folding box on a rack system.

In one embodiment, the arrangement, according to one embodiment of the invention, of the tamperproof surface (111), the adhesive bonding on the insertion flap (33), the articulation with the lid flap (12), and the adhesive bonding of the latter to the flap (32), and the articulation of a double-layer hanger (13, 14) result in a synergistic combination of advantageous folding-box designs and properties.

CONCLUSION

Many modifications and other embodiments of the invention will come to mind to one skilled in the art to which this invention pertains having the benefit of the teachings presented in the foregoing descriptions and the associated drawings. For example, while the hanger describe above is described as being described as comprising two layers, the hanger may alternatively comprise a single layer. Similarly, while the box is described above as having three side walls, the box may alternatively include only two side walls.

Accordingly, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

We claim:

1. A reclosable, cuboidal folding box comprising:

a front wall;

a rear wall-comprising a tamperproof surface that is adapted to be severed from said rear wall by way of one or more perforations;

at least two side walls that extend between said front wall and said rear wall;

a top closure that comprises:

a closure flap that is articulated on said front wall, and an insertion flap that is articulated on said closure flap, said insertion flap being disposed adjacent to and being adhesively bonded to said rear wall's tamperproof surface;

a lid flap that is articulated on the rear wall's tamperproof surface and that is disposed adjacent and adhesively bonded to the closure flap; and a hanger articulated on said lid flap, wherein:

said lid flap extends between said rear wall's tamperproof surface and said hanger.

2. The folding box of claim 1, wherein said hanger is a double-layer hanger that comprises two hanging tabs that are adhesively bonded together.

3. The folding box of claim 1, wherein said hanger is disposed adjacent a center of a top side of said folding box.

4. The folding box of claim 1, wherein said at least two side walls comprise a first side wall, a second side wall, and a third side wall, and wherein said second and third side walls are positioned one above the other.

5. The folding box of claim 1, wherein said top closure comprises one or more dust flaps.

6. The folding box of claim 1, wherein said folding box further comprises a base closure that comprises two base-closure flaps and two dust flaps.

7. The folding box of claim 1, wherein the lid flap is about half of the width of the closure flap.

8. The folding box of claim 1, wherein the lid flap is articulated on the front wall or the rear wall via perforations.

9. The folding box of claim 1, wherein said side walls and said closure flap have a smaller width than said front and rear walls.

10. The folding box of claim 1, wherein:

said closure flap is articulated on said front wall; and said tamperproof surface is articulated on said rear wall.

11. The folding box of claim 1, wherein said folding box is configured so that, as the box is opened for the first time:

when a user applies pressure to said tamperproof surface, said tamperproof surface is severed from said rear wall by way of said one or more perforations and separates from a body of said folding box; and as said user applies said pressure to said tamperproof surface, perforation-weakened connections between said box's lid flap and said folding box's body are separated from said rear wall.

12. The folding box of claim 11, wherein, after said tamperproof surface is severed from said rear wall by way of said one or more perforations, said tamperproof surface remains disposed adjacent said lid flap and said hanger.

* * * * *